United States Patent [19]

Wolcott, Jr.

[11] 4,446,918

[45] May 8, 1984

[54] METHOD FOR INITIATING COMBUSTION IN A SUBTERRANEAN CARBONACEOUS DEPOSIT

[75] Inventor: Herbert B. Wolcott, Jr., Plano, Tex.

[73] Assignee: Atlantic Richfield Company, Los Angeles, Calif.

[21] Appl. No.: 366,510

[22] Filed: Apr. 8, 1982

[51] Int. Cl.[3] ..... E21B 43/247; E21B 43/30

[52] U.S. Cl. ..... 166/245; 166/50; 166/259; 166/299

[58] Field of Search ..... 166/50, 245, 259, 299; 299/2, 13; 48/DIG. 6

[56] References Cited

U.S. PATENT DOCUMENTS

| | | | |
|---|---|---|---|
| 3,017,168 | 1/1962 | Carr | 299/2 |
| 3,209,825 | 10/1965 | Alexander et al. | 166/245 |
| 3,565,173 | 2/1971 | Anderson | 166/299 |
| 3,659,652 | 5/1972 | Roberts | 166/299 |
| 3,734,180 | 5/1973 | Rhoades | 166/259 |
| 3,999,607 | 12/1976 | Pennington et al. | 166/259 |
| 4,022,279 | 5/1977 | Driver | 166/299 X |
| 4,026,356 | 5/1977 | Shuck | 166/259 |
| 4,109,964 | 8/1978 | Ridley | 166/259 X |
| 4,222,437 | 9/1980 | Sabol | 166/245 |
| 4,356,866 | 11/1982 | Savings | 166/50 X |

*Primary Examiner*—George A. Suchfield
*Attorney, Agent, or Firm*—F. Lindsey Scott

[57] ABSTRACT

A method for initiating combustion in a subterranean carbonaceous deposit by positioning at least two wellbores from the surface into the subterranean deposit; extending a first borehole substantially horizontally from a first wellbore into the vicinity of a second wellbore; extending a second borehole substantially horizontally from a second wellbore into the vicinity of the first wellbore; positioning an explosive charge in at least one of the boreholes; detonating the explosive charge to produce a rubblized zone between the first wellbore and the second wellbore; injecting a free-oxygen containing gas into the carbonaceous deposit through one of the wellbores; and igniting the carbonaceous deposit at one of the wellbores.

4 Claims, 2 Drawing Figures

METHOD FOR INITIATING COMBUSTION IN A SUBTERRANEAN CARBONACEOUS DEPOSIT

Figure 1:
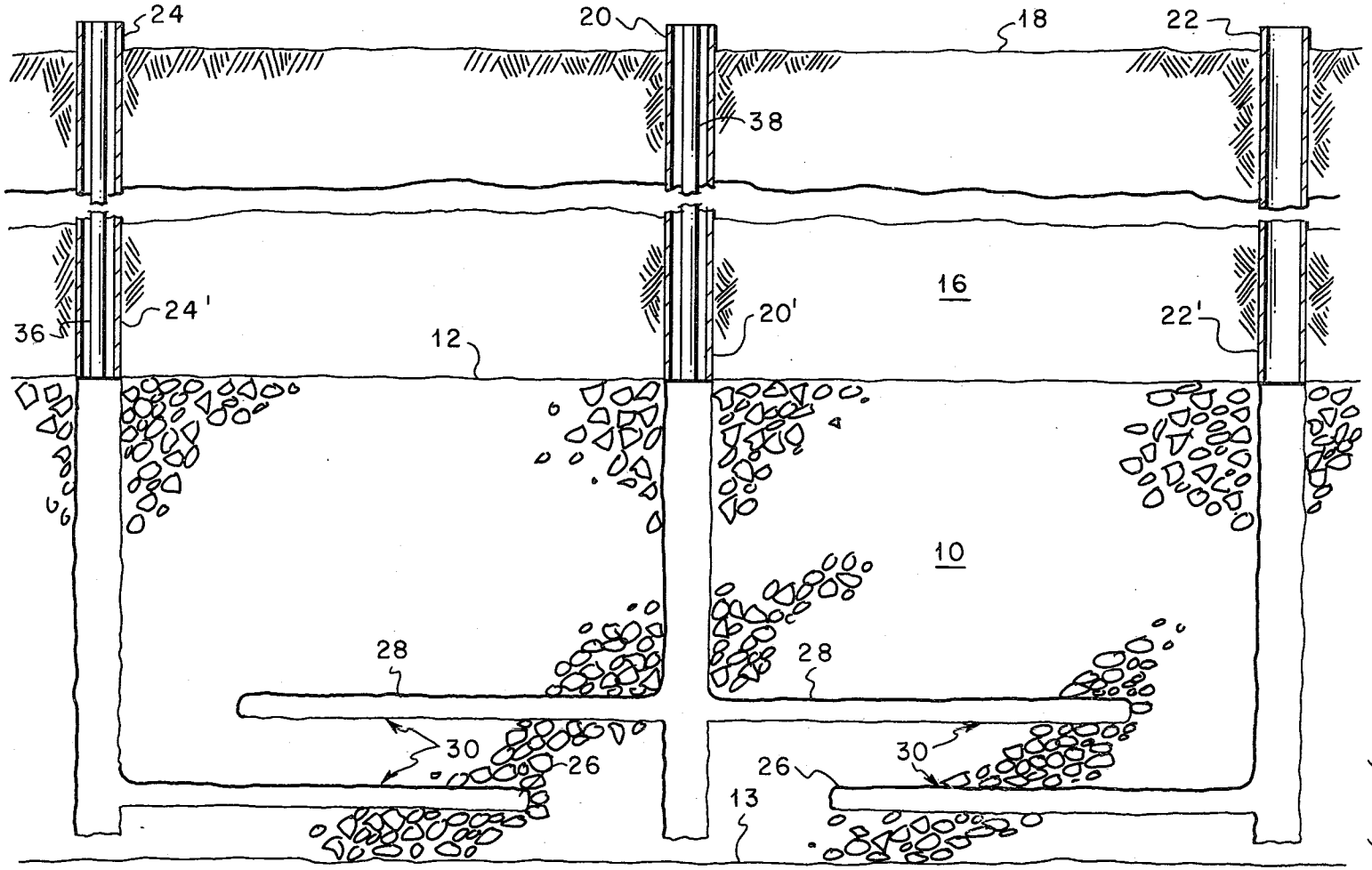

This invention relates to methods for igniting subterranean carbonaceous deposits.

This invention further relates to a method for igniting subterranean carbonaceous deposits so that combustion is readily initiated in such deposits for the production of gasification products.

In recent years there has been increased interest in developing improved methods for the recovery of heat and energy values from carbonaceous deposits of all types. One area of interest has been the gasification of subterranean coal deposits which are located in seams too thin for commerical exploitation by conventional mining methods; which are of a coal quality such that commerical mining is impractical; which lie at depths which render their production by conventional mining methods impractical, or the like. Considerable effort has been directed to the development of methods whereby such coal deposits can be gasified in situ with the resulting gaseous products being recovered and upgraded to various fuels, such as synthetic natural gas, liquid hydrocarbonaceous products, and the like.

In the gasification of subterranean coal deposits in situ, a continuing problem is the initiation of combustion in the coal deposit and control of the burn path once combustion is initiated. For instance, it is generally considered desirable that combustion proceed near the bottom of the carbonaceous deposit first, so that, as combustion proceeds, fresh carbonaceous material collapses into the combustion zone rather than allowing combustion to proceed from the top of the carbonaceous deposit so that the lower portions of the carbonaceous deposit become covered with ash, debris, and the like, with the result that combustion is incomplete. When combustion proceeds near the top of the carbonaceous deposit the overburden is likely to collapse into the burn zone impeding production and wasting considerable heat to heat the collapsed overburden. A further problem has been that many subterranean carbonaceous deposits such as coal of varying grades are relatively impermeable and do not permit the passage of free-oxygen containing gases through the deposit as required for combustion. Considerable effort has been directed to the development of methods whereby combustion can be initiated and whereby the path of combustion in the carbonaceous deposits can be controlled. One technique which has been used in the past is called reverse combustion linking. By this process, free-oxygen containing gas is injected into a first wellbore and, upon establishing a suitable flow of free-oxygen containing gas through the carbonaceous deposit to a second wellbore, combustion is initiated at the second wellbore with the combustion then proceeding along the gas flow path to establish a link back to the first wellbore. Gasification is then accomplished by injecting a free-oxygen containing gas into one of the wellbores and recovering gasification products from the other. This technique requires that the subterranean carbonaceous deposit have sufficient permeability initially to permit air communication between the wells. Further, by this technique, the path of the reverse combustion link tends to follow the path of least resistance to gas flow and may go to the top of the coal seam. The exact location of the reverse combustion link is difficult to control. As a result, coal beneath the link may not be recovered as efficiently, if at all, as when the link is positioned in the lower portion of the carbonaceous deposit.

It has now been found that improved in situ combustion of a subterranean carbonaceous deposit is accomplished by a method which consists essentially of (a) extending a first borehole substantially horizontally from a first wellbore in the carbonaceous deposit into the vicinity of a second wellbore in the carbonaceous deposit; (b) extending a second borehole substantially horizontally from the second wellbore in the carbonaceous deposit into the vicinity of the first wellbore; (c) positioning an explosive charge in at least one of the boreholes; (d) detonating said explosive charge to produce a rubblized zone between the first wellbore and the second wellbore; (e) igniting the carbonaceous deposit at one of the wellbores; and, (f) injecting a free-oxygen containing gas into the carbonaceous deposit through one of the wellbores.

A variety of well patterns can be used in the practice of the method of the present invention.

Figure 2:
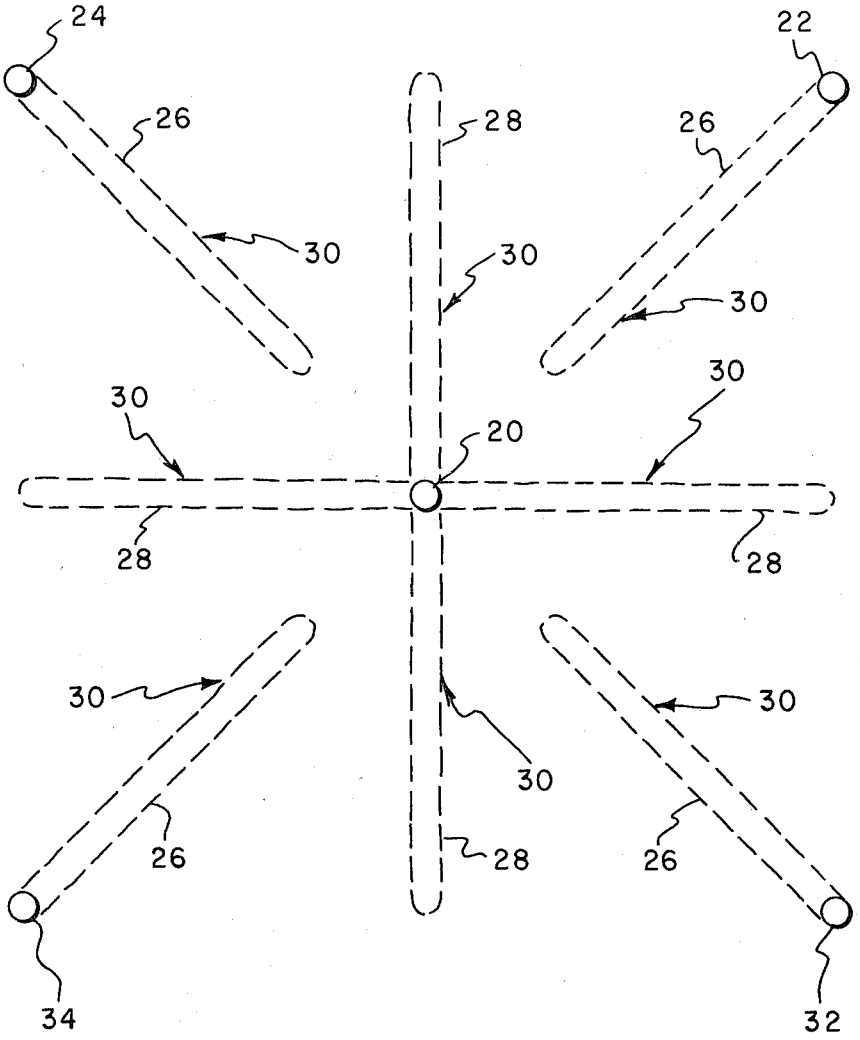

FIG. 1 is a schematic diagram of an embodiment of the process of the present invention wherein three wellbores are used; and, FIG. 2 is a top view of a five well pattern, indicating the positioning of the boreholes used in the method of the present invention.

In the discussion of the Figures, the same numbers will be used to refer to the same or similar components throughout. In FIG. 1 a carbonaceous deposit 10 is shown beneath an overburden 16. Carbonaceous deposit 10 is penetrated by a first wellbore 20, a second wellbore 22 and a third wellbore 24 from the surface 18. Wellbores 20, 22, and 24 extend to near the bottom 13 of carbonaceous deposit 10 and are cased with casings 20', 22', and 24', respectively, to the top 12 of carbonaceous deposit 10. Boreholes 28 extend substantially horizontally outwardly from wellbore 20 into the vicinity of wellbores 22 and 24. Boreholes 26 extend substantially horizontally from wellbores 22 and 24 into the vicinity of wellbore 20. Explosives are conveniently positioned in either boreholes 26 or 28 at points indicated by the arrows 30. Explosives need not be positioned in both boreholes 26 and 28 unless required, but it is desirable that the material between boreholes 26 and 28 be rubblized, so that a rubblized zone of carbonaceous material is positioned between wellbore 22 and wellbore 20 and wellbore 20 and wellbore 24. Free-oxygen containing gas is then conveniently injected through one of the wellbores, conveniently wellbore 20, and ignition of the subterranean deposit is accomplished at wellbores 22 and 24. Combustion then proceeds through the rubblized zone as known to those in the art. Reverse combustion or forward combustion could be used. It is clear that by the use of the technique of the present invention ignition of carbonaceous deposit 10 is accomplished near bottom 13 of carbonaceous deposit 10 and combustion proceeds near bottom 13 of deposit 10.

As shown, wellbores 20, 22, and 24 are not cased beneath the top of carbonaceous deposit 10. Clearly, additional casing could be used if required. Further, wellbore 20 may include a tubing 38 for the injection of free-oxygen containing gas if desired. When tubing 38 is used, free-oxygen containing gas is typically injected through tubing 38 with a heat transfer material such as steam, carbon dioxide, or the like, being injected down the annulus between casing 20' and tubing 38.

Well 24 as shown includes a tubing 36. In many instances it is believed that tubing will not be necessary in the gas recovery wells, although in some instances such may be desirable. Tubing 36 may extend into the carbonaceous deposit as required for the efficient recovery of production gases. When cooling is required, liquid water or the like may be injected down the annulus between casing 24' and tubing 36.

Further, boreholes 26 and 28 may be as shown with the boreholes 28 from well 20 above boreholes 26 from wells 22 and 24, or boreholes 28 may be beneath boreholes 26. Further, the boreholes may be on substantially the same level, although desirably the boreholes should not intersect. While the boreholes are desirably substantially horizontal when the coal deposit is substantially horizontal, the boreholes may be oriented at various angles if used in a sloping coal seam, etc. "Desirably the boreholes are positioned near the bottom of the coal deposit."

FIG. 2 is a top view of a five well pattern including boreholes positioned for the practice of the present invention. Additional wellbores 32 and 34 are positioned as shown. Explosives may be positioned in any or all of the boreholes as required for the efficient rubblization of the zone between the boreholes. Suitable locations for the explosives are shown by arrows 30.

Carbonaceous deposits suitable for the practice of the present invention are generally subterranean coal deposits of various grades. Such coals are well known to those skilled in the art and constitute brown coal, lignite, sub-bituminous, bituminous, and anthracite coal. It it believed that the coals normally chosen for such in situ gasification will be the lower grade coals, although the method of the present invention could be used with higher grade coals as well.

In general, the rubble zone achieved by the method of the present invention lies between the wells to be used for the production of gasification products from the subterranean carbonaceous deposit. The zone is rubblized rather than merely compacted and fractured, as is the case when explosives are merely detonated in a hole penetrating the subterranean deposit, because room for expansion and fragmentation of the subterranean deposit is available in the form of the space constituting boreholes 26 and 28. The rubble zone so created is highly permeable and readily permits the flow of free-oxygen containing gas so that upon the accomplishment of ignition, at a wellbore such as wellbore 22 or 24, with free-oxygen containing gas being injected from well 20, combustion is initiated and rapidly travels toward well 20. Various methods for gasifying subterranean deposits, once a link is established, are well known to those skilled in the art and may involve forward combustion, reverse combustion, or variations thereof.

While the invention is not so limited since combustion could be accomplished by the process of the present invention throughout substantially the entire width of a relatively thin seam, it is believed that the method of the present invention is particularly suited to the initiation of combustion at the bottom of a relatively thick coal or other carbonaceous deposit. While the invention has been shown by reference to a three well arrangement and a five well arrangement, it should be appreciated that two or more wells could be used. The primary requisite is that a rubblized zone be created between the wellbores by suitably positioning boreholes and explosives so that upon initiation of combustion in the subterranean deposit all wells are in fluid communication with each other, with a previously combusted zone or the like. Such variations and modifications are obvious to those skilled in the art based upon the preceding discussion and need not be discussed further.

By the practice of the present invention, various improvements are accomplished. For instance, steps such as reverse combustion linking are no longer required; coal gasification is started at the bottom of a coal seam in a very controlled fashion so that the gasification is closely controlled; the surface area of the coal exposed for gasification is greater than is normally accomplished in reverse combustion linking; and coal recovery is improved since the link is accurately and reliably positioned in the bottom of the coal or other carbonaceous deposit.

Having thus described the present invention by reference to certain of its preferred embodiments, it is noted that the embodiments described are illustrative rather than limiting in nature and that many variations and modifications are possible within the scope of the present invention. Many such variations and modifications may be considered obvious and desirable by those skilled in the art upon a review of the foregoing description of preferred embodiments.

Having thus described the invention, I claim:

1. A method for initiating combustion in a subterranean coal deposit penetrated by a plurality of wellbores, said method consisting essentially of:

(a) penetrating said coal deposit with a first wellbore;

(b) positioning a plurality of other wellbores about said first wellbore, each of said other wellbores having at least one substantially horizontal borehole extending therefrom into the vicinity of said first wellbore;

(c) extending a plurality of substantially horizontal boreholes from said first wellbore into the vicinity of said other wellbores (d) positioning explosive charges in at least a portion of said boreholes;

(e) detonating said explosive charges to produce a rubblized zone between said first wellbore and said other wellbores (f) igniting said coal deposit in at least one of said wellbores; and (g) injecting a free-oxygen containing gas into said coal deposit through at least one of said wellbores to gasify said coal deposit in situ and produce gasification products.

2. The method of claim 1 wherein said boreholes are positioned near the bottom of said coal deposit.

3. A method for producing gasification products from a subterranean coal deposit penetrated by a plurality of wellbores by an in situ coal gasification method consisting essentially of:

(a) penetrating said coal deposit with a first wellbore;

(b) positioning a plurality of other wellbores about said first wellbore, each of said other wellbores having at least one substantially horizontal borehole extending therefrom into the vicinity of said first wellbore;

(c) extending a plurality of substantially horizontal boreholes from said first wellbore into the vicinity of said other wellbores;

(d) positioning explosive charges in at least a portion of said boreholes;

(e) detonating said explosive charges to produce a rubblized zone between said first wellbore and said other wellbores;

(f) igniting said coal deposit in at least one of said wellbores; and (g) injecting a free-oxygen containing gas into said coal deposit through at least one of said wellbores to gasify said coal deposit in situ and produce gasification products.

4. The method of claim 3 wherein said boreholes are positioned near the bottom of said coal deposit.

* * * * *